United States Patent [19]

Shimada et al.

[11] 4,175,505

[45] Nov. 27, 1979

[54] VALVE ROTATOR ASSEMBLY

[75] Inventors: Shinichi Shimada, Kamifukuoka; Takenori Makino, Okegawa, both of Japan

[73] Assignee: Honda Giken Kogyo Kabushiki Kaisha, Tokyo, Japan

[21] Appl. No.: 847,231

[22] Filed: Oct. 31, 1977

[30] Foreign Application Priority Data

Nov. 11, 1976 [JP] Japan ..... 51/150610[U]
Dec. 2, 1976 [JP] Japan ..... 51/160476[U]

[51] Int. Cl.[2] ..... F01L 1/32
[52] U.S. Cl. ..... 123/90.3; 137/331
[58] Field of Search ..... 123/90.28, 90.3; 137/331

[56] References Cited

U.S. PATENT DOCUMENTS

| | | | |
|---|---|---|---|
| 2,582,060 | 1/1952 | Newton | 123/90.3 |
| 2,806,460 | 9/1957 | Beardsley | 123/90.3 |
| 2,819,706 | 1/1958 | Gammon | 123/90.3 |
| 3,421,734 | 1/1969 | Updike et al. | 123/90.3 |
| 3,710,768 | 1/1973 | May | 123/90.3 |
| 4,094,280 | 6/1978 | Updike | 123/90.3 |

FOREIGN PATENT DOCUMENTS

| | | | |
|---|---|---|---|
| 2163787 | 7/1973 | Fed. Rep. of Germany | 123/90.3 |
| 2208466 | 8/1973 | Fed. Rep. of Germany | 123/90.3 |
| 715889 | 9/1954 | United Kingdom | 123/90.3 |

*Primary Examiner*—Charles J. Myhre
*Assistant Examiner*—Jeffrey L. Yates
*Attorney, Agent, or Firm*—Lyon & Lyon

[57] ABSTRACT

A rotator assembly for a poppet valve employed in an internal combustion engine employs a garter spring mounted in a circular groove concentric with the valve axis. A rotator plate rests on the garter spring so that the plate turns incrementally through a small arc each time the valve completes its opening and closing cycle. Concentric coil compression springs resist opening movement of the poppet valve and both of these springs are supported by a valve retainer which rests on the rotator plate. The lower ends of both springs are supported at the same elevation and the springs are centralized by means of integral fingers struck from the retainer ring to hold one or both springs in central position.

1 Claim, 6 Drawing Figures

VALVE ROTATOR ASSEMBLY

This invention relates to an improved form of rotator for a poppet valve assembly of an internal combustion engine.

Prior art valve rotator devices have employed a garter spring mounted in a circular groove in a stationary member. A flat rotator plate rests on the garter spring and supports a retainer for a pair of concentric valve springs. Reciprocating movement of the poppet valve between open and closed position changes the force exerted by the springs and this change causes the rotator plate to creep incrementally in an arc about the axis of the poppet valve, carrying the poppet valve and associated mechanism with it.

A serious short-coming in the prior art device is that the inner valve spring must be shorter than the outer valve spring. This has a detrimental effect on the operation of the poppet valve, and results in an assembly too great in cverall height for easy installation in conventional engines.

The present invention employs a valve retainer which rests on the rotator plate, but which is constructed so as to support the lower ends of both valve springs at the same elevation. In this way, the valve springs may be of the same length, and the overall height of the rotator assembly is diminished to facilitate installation.

Other and more detailed objects and advantages will appear hereinafter.

Figure 1:
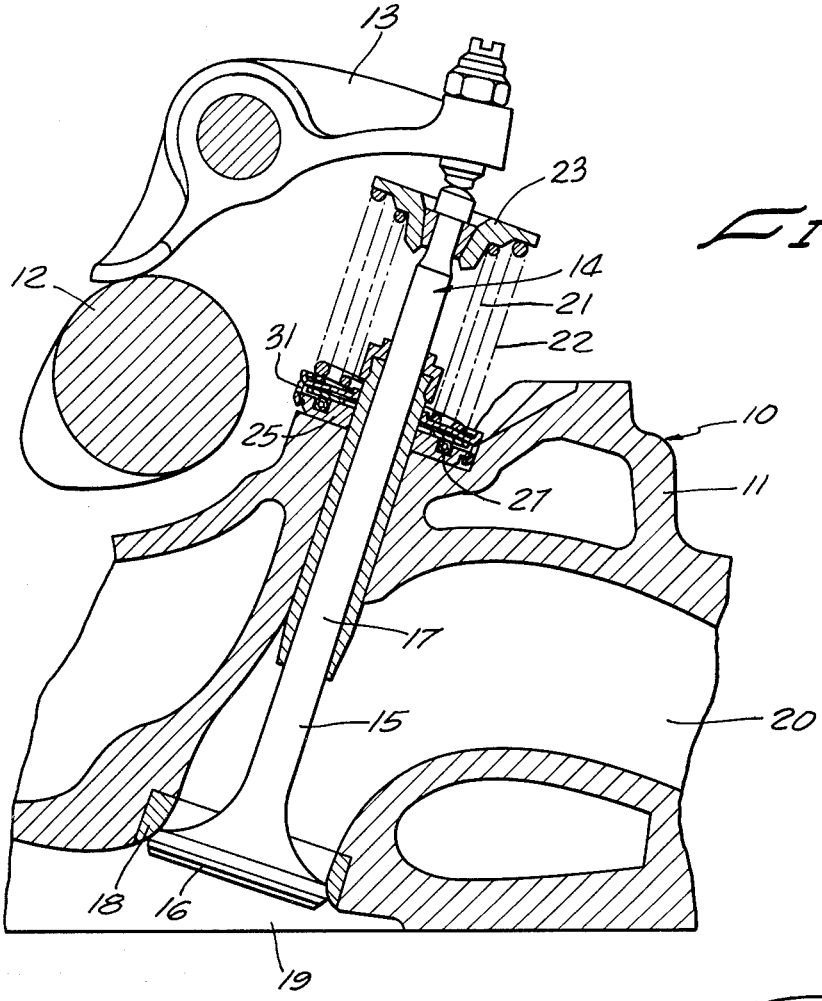
FIG. 1 is a sectional elevation showing a portion of an internal combustion engine and illustrating a preferred embodiment of this invention.

Referring to the drawings, the internal combustion engine generally designated 10 is provided with a cylindrical head 11, a cam shaft 12, a rocker arm 13, and a poppet valve assembly generally designated 14. The assembly 14 includes the poppet valve 15 having a valve head 16 and a valve stem 17 guided for reciprocating movement. The valve head 16 closes against the stationary valve seat 18. Closure of the valve head 16 against the valve seat 18 shuts off communication between the combustion chamber 19 and the flow passage 20 in the cylinder head 11.

The poppet valve assembly 14 includes a pair of concentric coil compression springs 21 and 22 encircling a portion of the stem 17 and contacting the retainer 23 removably secured to the upper end of the valve stem 17. In the general plan of operation, rotation of the cam shaft 12 causes the rocker arm 13 to move the valve head 16 away from the valve seat 18 against the force of the springs 21 and 22, which springs return the valve to closed position as the cam shaft 12 continues to rotate. Accordingly, the poppet valve assembly reciprocates while the engine is in operation.

Figure 4:
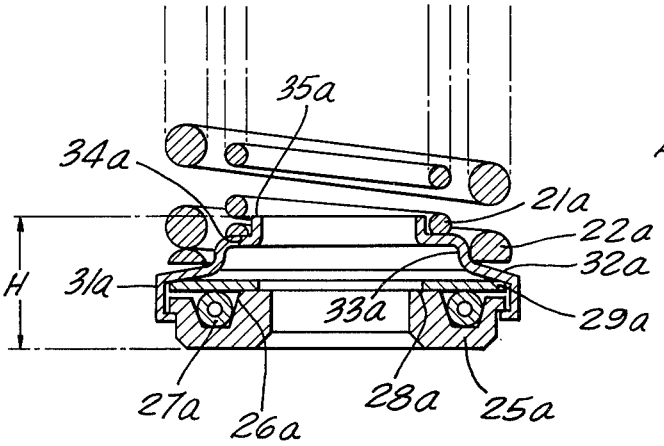
FIG. 4. PRIOR ART
FIG. 4 is a view similar to FIG. 2 showing a prior art device.

It is desirable to cause the valve head 16 to turn slightly with respect to the stationary seat 18 for each reciprocating stroke of the valve. The turning movement should occur while the valve head 16 is separated from the seat 18. A prior art device to accomplish this purpose is shown in FIG. 4 and includes a stationery support ring 25*a* provided with a circular groove 26*a*. A garter spring 27*a* is received within the groove and extends slightly above the shoulder 28*a*. An annular rotator plate 29*a* rests on the garter spring 27*a*. An annular spring retainer 31*a* has a tapered shoulder 32*a* which is contacted by the lower end of the outer spring 22*a*. A substantially cylindrical portion 33*a* of the spring retainer 31*a* forms the inner boundary of the shoulder 32*a* and also forms an internal guide for centering the outer coil spring 32*a*. Another shoulder 34*a* is formed on the spring retainer 31*a* between the generally cylindrical portion 33*a* and the inner cylindrical portion 35*a*. The inner coil spring 21*a* rests on the shoulder 34*a* and is centered by means of the internal cylindrical portion 35*a*. It should be noted that the lower end of the inner spring 21*a* is supported at a higher elevation than the lower end of the outer spring 22*a*. Furthermore, the overall height of the assembly is shown at "H" in FIG. 4. In the operation of the prior art device, the cyclically changing load exerted by the coil springs 21*a* and 22*a* on the retainer 31*a* is transmitted to the rotator plate 29*a* resting on the garter spring 27*a*. The rotator plate 29*a* is moved incrementally through a small arc each time the springs expand and contract.

Figure 2:
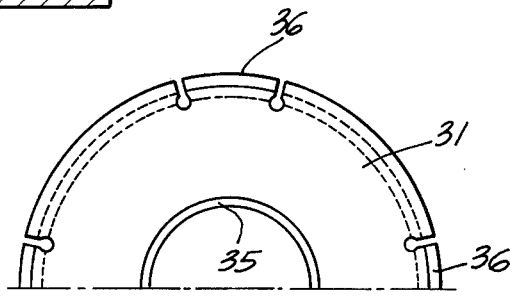
FIG. 2 is an enlargement of a portion of FIG. 1.

The apparatus embodying this invention has the same mode of operation but the overall height of the rotator device as shown at "h"in FIG. 2 is much less than the overall height "H" of the prior art device as shown in FIG. 4. In the prior art device the inner coil spring must be shorter than the outer coil spring, thereby adversely affecting the operation of the valve.

For example, each centering portion 33*a* and 35*a* of the prior art device is required to have a height at least equal to or more than 50% of the wire diameter of the spring, and thus, where the wire diameter 21*a* is assumed to be 2.5 mm and that of the outer spring 22*a* to be 3.5 mm, the rotator assembly is increased in height "H" by at least 3.0 mm, thereby making it difficult to be assembled into conventional engines.

Figure 3:
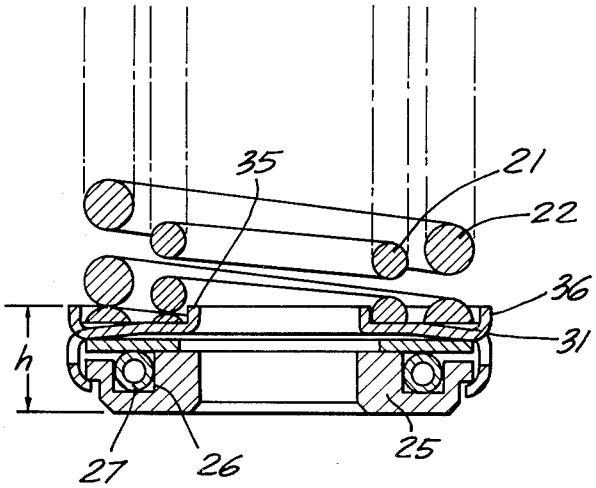
FIG. 3 is a plan view partly broken away of the spring retainer shown in FIG. 2.

The device of this invention as shown in FIGS. 2 and 3 is free from the height disadvantage. The spring retainer 31 has an annular section which is almost flat and which supports the lower ends of the springs 21 and 22 at substantially the same height. The inner cylindrical lip 35 centers the inner spring 21, and a series of fingers 36 are struck from the body of the retainer 31 to center the outer coil spring 22.

Figure 5:
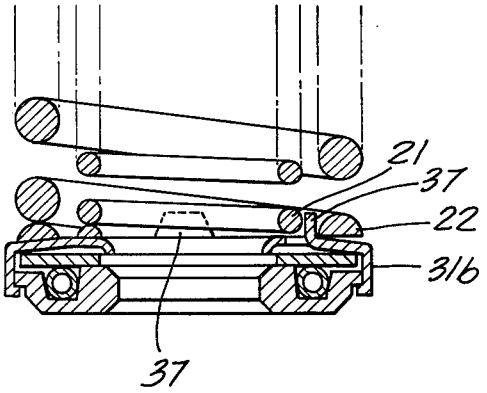
FIG. 5 is a sectional view similar to FIG. 2 showing a modified form of this invention.
Figure 6:
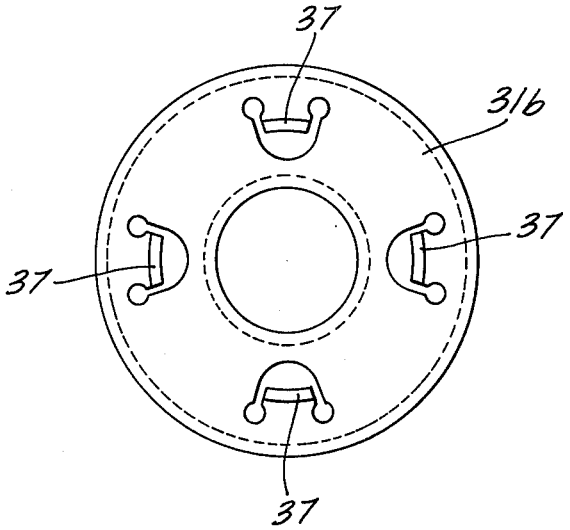
FIG. 6 is a plan view showing the spring retainer of FIG. 5.

In the modified form of this invention shown in FIGS. 5 and 6, the retainer ring 31*b* supports the lower end of the coil springs 21 and 22 at the same elevation. A series of fingers 37 are struck from the body of the retainer 31*b* and project upward between the concentric springs 21 and 22. Thus, these fingers 37 center the inner spring 21 by contact with its outer surface, while at the same time the fingers 37 center the outer spring 22 by contact with its inner surface. In other respects, the device of FIGS. 5 and 6 is similar in construction and mode of operation to the device as shown in FIGS. 2 and 3.

Having fully described our invention, it is to be understood that we are not to be limited to the details herein set forth but that our invention is of the full scope of the appended claims.

We claim:

1. For use with a poppet valve assembly for a combustion chamber of an internal combustion engine, said assembly including a poppet valve having a stem, a pair of concentric coil compression springs encircling a portion of the stem and a retainer removably attached to the valve stem and contacted by the upper end of each spring, the improvement comprising, in combination: a stationary support member encircling the valve stem and having a concentric upward facing continuous groove therein, a garter spring in said groove and projecting slightly out of the groove, an annular rotator plate engaging said garter spring, and a retainer ring resting on said rotator plate and providing an upward facing shoulder for supporting the lower end of each of said coil springs at the same elevation, said retainer ring having integral fingers projecting therefrom contacting the outside of the outer coil spring and also having an inner cylindrical lip contacting the inside of the inner spring to hold these springs in concentric position.

* * * * *